US012274313B2

(12) United States Patent
Adams

(10) Patent No.: US 12,274,313 B2
(45) Date of Patent: Apr. 15, 2025

(54) WOMENS' UNDERGARMENT APPARATUS

(71) Applicant: Kenya Adams, Murfreesboro, TN (US)

(72) Inventor: Kenya Adams, Murfreesboro, TN (US)

( * ) Notice: Subject to any disclaimer, the term of this patent is extended or adjusted under 35 U.S.C. 154(b) by 0 days.

(21) Appl. No.: 17/338,501

(22) Filed: Jun. 3, 2021

(65) Prior Publication Data

US 2021/0401066 A1 Dec. 30, 2021

Related U.S. Application Data

(60) Provisional application No. 63/044,039, filed on Jun. 25, 2020.

(51) Int. Cl.

| | |
|---|---|
| ***A41B 9/12*** | (2006.01) |
| ***A41F 19/00*** | (2006.01) |
| ***A45C 13/30*** | (2006.01) |
| ***A45F 5/02*** | (2006.01) |
| ***A47K 10/32*** | (2006.01) |
| ***A47K 17/00*** | (2006.01) |
| *A45F 5/10* | (2006.01) |

(52) U.S. Cl.

CPC ..... *A41B 9/12* (2013.01); *A41F 19/00* (2013.01); *A45C 13/30* (2013.01); *A45F 5/02* (2013.01); *A47K 10/32* (2013.01); *A47K 17/003* (2013.01); *A41B 2300/00* (2013.01); *A45F 2005/1086* (2013.01)

(58) Field of Classification Search

CPC ..... A41B 2300/00; A41B 9/12; A41F 19/00; A45C 13/30; A45F 3/006; A45F 2003/008; A45F 2005/008; A45F 2005/1086; A45F 2200/05; A45F 2200/0575; A45F 5/02; A45F 5/021; A47K 10/32; A47K 17/003; Y10T 24/318

USPC ..... 224/255

See application file for complete search history.

(56) References Cited

U.S. PATENT DOCUMENTS

| | | | | |
|---|---|---|---|---|
| 5,573,441 | A * | 11/1996 | Smith | A41C 3/0035 150/134 |
| 6,752,305 | B2 * | 6/2004 | Shattuck | A45F 5/00 150/145 |
| 7,204,398 | B1 * | 4/2007 | Smith, Sr. | A45C 1/08 150/144 |
| 7,575,137 | B1 * | 8/2009 | Lederer | A45F 5/00 224/601 |
| 2003/0150536 | A1 * | 8/2003 | Morehead | A45C 11/323 150/134 |
| 2013/0062246 | A1 * | 3/2013 | Staples | A45C 11/008 206/581 |

* cited by examiner

*Primary Examiner* — Nathan J Newhouse
*Assistant Examiner* — Matthew T Theis
(74) *Attorney, Agent, or Firm* — Steven R. Fairchild

(57) ABSTRACT

The present invention protects undergarments during use in a public restroom. In particular, the undergarments are secured to a tail-strap by fastening a rough velcro portion and a smooth velcro portion them. This is secured to the body of the device, which then dangles from the restroom's doorknob. The entire device can securely folded together for discreet transport.

1 Claim, 2 Drawing Sheets

WOMENS' UNDERGARMENT APPARATUS

CROSS REFERENCE TO RELATED APPLICATION

This application is a continuation-in-part of U.S. Provisional Patent Application 63/044,039, filed on Jun. 25, 2020.

FIELD

The present invention relates to the field of undergarment protection apparatuses.

BACKGROUND OF THE INVENTION

Restrooms are hotspots of microscopic organisms, such as bacteria, fungi, viruses, and protozoa.

Public restrooms are notorious for having larger amounts of microscopic organisms due to greater traffic in between cleanings. Further, no one has any control over the hygiene levels of the prior users of any public toilet. As a consequence, people fear touching the toilet seat of any public restroom.

One only needs to consider the toilet of a gas station, a crowded late-night club used by a flood of the inebriated, an outhouse by a campground, or squatting by the proverbial hole-in-the-ground to immediately envision the problem. Sometimes, people do not want to touch anything, but nature calls.

Put simply, public restrooms can be nasty.

The desire to not touch anything also extends to one's undergarments. Failing to remove the undergarments means dragging them across the restroom floor. This infects one's undergarments with the same filth of the bathroom floor—be it microscopic organisms or a twelve pack of beer that was vomited out by the prior occupant and entirely missed the porcelain throne.

One option people can do is to cover the seat with toiler paper. However, this method is only useful if the restroom has enough paper to use. If the paper is in limited supply, then a person might choose to hover over the toilet during use. This could create a much larger mess for later occupants to endure. If not cleaned, then they know who to blame.

Likewise, a person might want to remove their undergarments to prevent touching it on the floor. The user must then balance herself while holding her panties in one hand with other hand in use. After a few drinks, this never ends well.

The present invention overcomes these problems.

SUMMARY OF THE INVENTION

A device for the protection of undergarments, comprising:

A body portion consisting of a left flap and a right flap;

A tail-strap portion consisting of a smooth velcro portion and a rough velcro portion; and, A handle.

The handle of [0012] wherein it is connected to the body portion with a dog-leash.

The handle of [0012] wherein it is a looped fabric.

The body portion of [0012] wherein it has a snap closure webbing.

The snap closure webbing of [0015] wherein it is made of nylon.

The tail-strap portion of [0012] wherein it is 20 inches long and 1 inch thick.

The left flap of [0012] wherein it has a dye-cut ovular hole.

The left flap of [0012] wherein it has a female fastener.

The right flap of [0012] wherein it has a male fastener.

The left flap of [0012] wherein it has a slash pocket.

The right flap of [0012] wherein it has a slash pocket.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF THE PREFERRED EMBODIMENTS

For a more complete understanding of the present invention, the objects and advantages thereof, reference is now made to the ensuing descriptions taken in connection with the accompanying drawings briefly described as follows.

The present invention make it easier for women to protect their undergarments from touching the floor of a public restroom.

Normally, the tail-strap portion is tucked into the body portion with the two flaps snapped shut. Upon entering a public restroom, a woman releases the two snaps, unfolds the body, and the tail-strap portion is release.

A woman secures her undergarments with the two sides of the velcro strap sewn onto the tail-strap. The woman secures the device onto the handle of the restroom door and the entire assortment is dangled from the device's looped-strap. This prevents the undergarments from touching the floor.

As a further advantage, the present invention small, compact, and easily serves as a discreet carrying case for toilet paper, toilet seat covers, feminine hygiene products, and the like.

EXAMPLES

Figure 1:
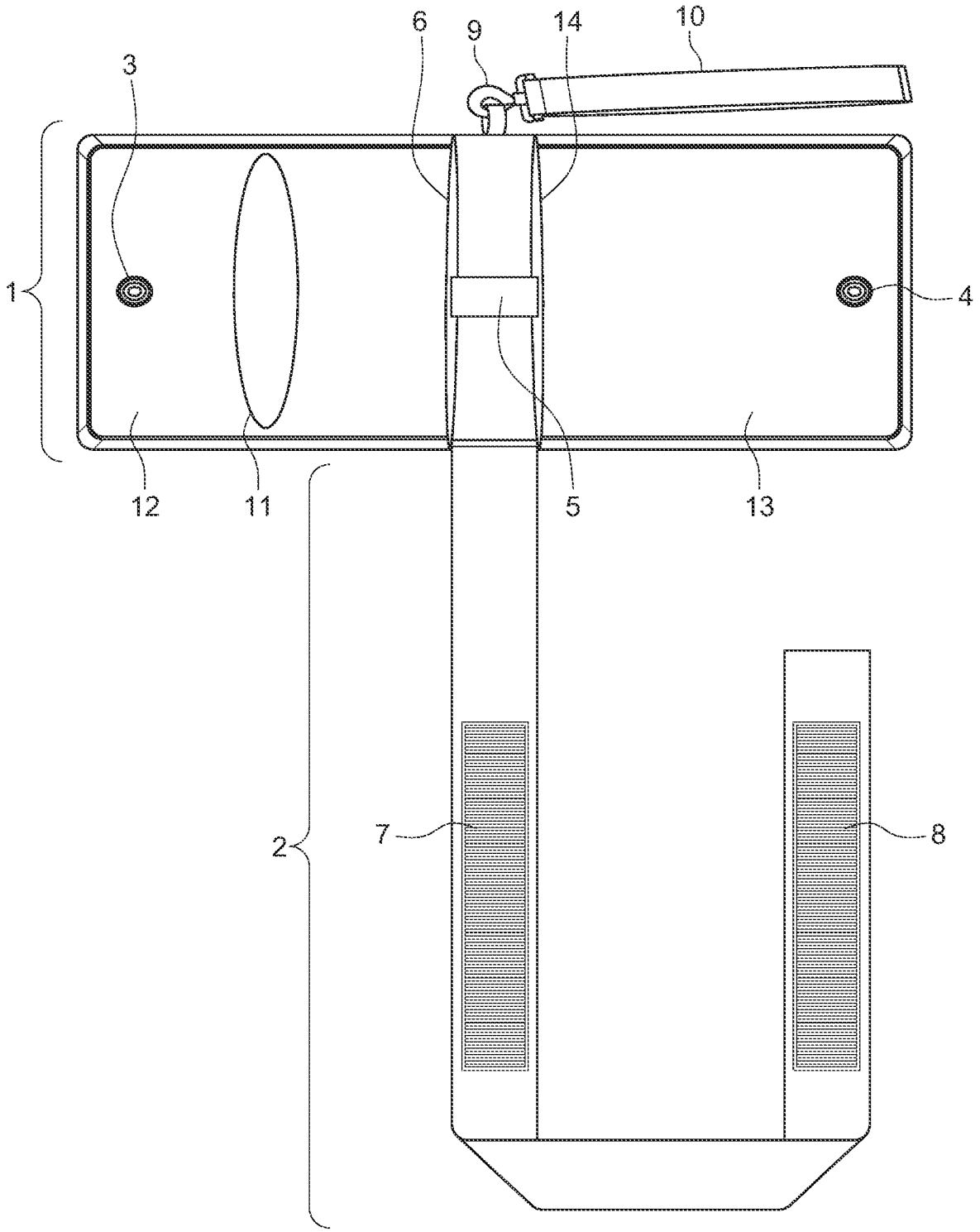
FIG. 1 is a perspective view of the invention that shows the body portion opened and the extended strap tail portion. In this variant, there is a single compartment for dispensing toilet paper.

Reference is made to FIG. 1, which is a perspective view of the invention that shows the body portion (Item 1) with the respective right (Item 13) and left (Item 12) flaps reflected and the tail-strap portion (Item 2) released.

Figure 2:
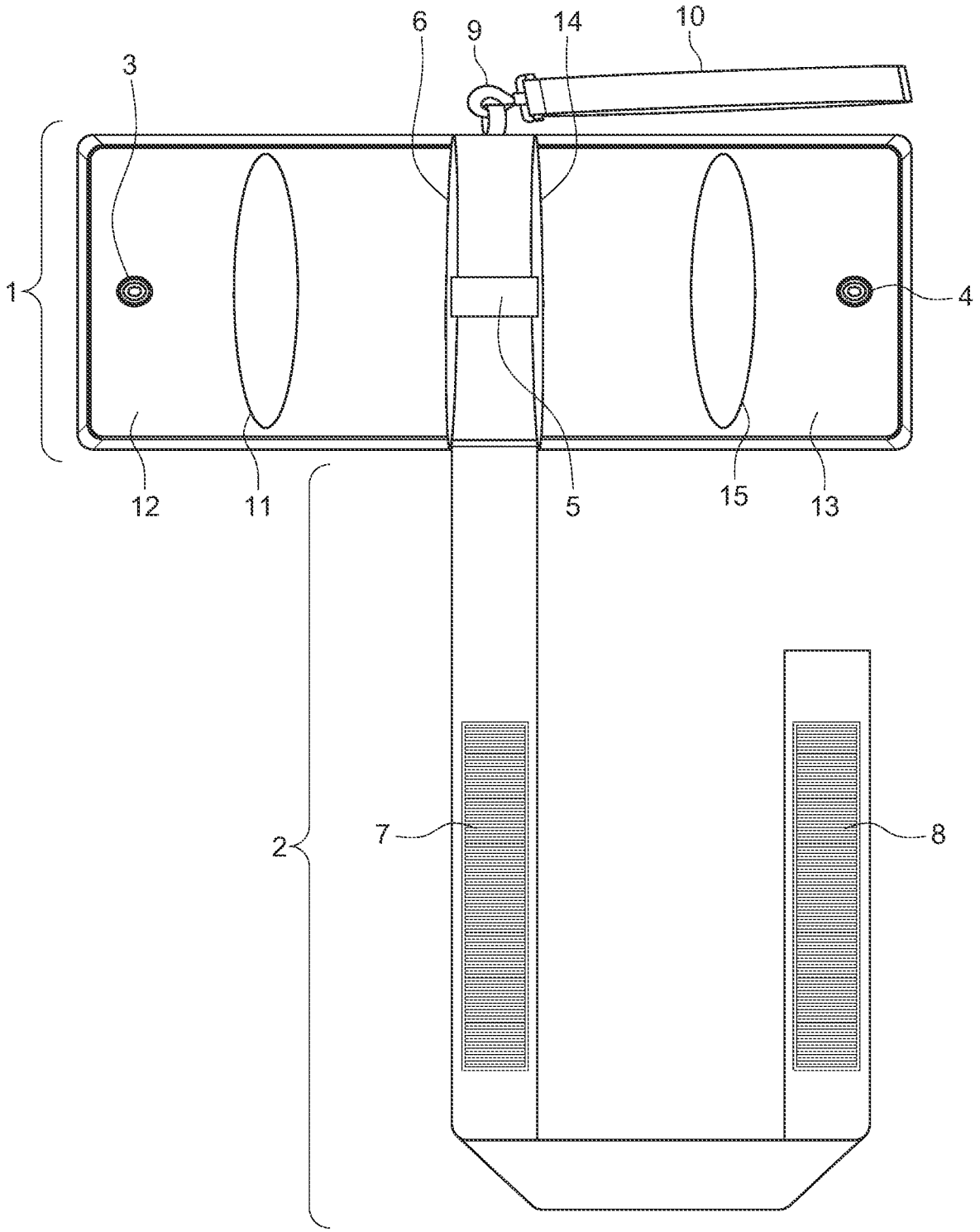
FIG. 2 is a perspective view of the invention that shows the body portion opened and the extended tail portion. In this variant, there are two compartments for dispensing toilet paper.

Reference is also made to FIG. 2, which also is a perspective view of the invention that shows the body portion (Item 1) with the respective right (Item 13) and left (Item 12) flaps reflected and the tail portion (Item 2) released. FIGS. 1 and 2 are identical, except that FIG. 1 has a single compartment (11) on the left flap (12) for dispensing toilet paper whereas FIG. 2 has two such compartments.

In a preferred embodiment, the body portion is made from vegan leather and canvas nylon. In particularly preferred embodiment, the canvas nylon is 190T nylon.

In a preferred embodiment, the body portion is made from a single piece of vegan leather that is approximately 4½ inches wide and 10¾ inches long.

Item (3) designates the female snap on the left flap (12). Item (4) designates the male snap on the right flap (13). The fastening of the female snap with the male snap secures the left flap with the right flap and closes the body portion into a discreet carrying case for transport. Item (5) designates the snap closure webbing, which holds the folded tail-strap in place when the left flap and the right flap are secured and closed.

In a preferred embodiment, the snap closure webbing is made of nylon.

Item (6) designates a slash pocket on the left flap and item (14) designates a slash pocket on the right flap. In a preferred embodiment, these two slash pockets enable the user to discreetly carry additional items, such as feminine hygiene products.

Item (2) designates the tail-strap portion. In a preferred embodiment, the tail-strap portion is 1 inch wide and 20 inches long. The tail-strap portion secures to the base of the body portion.

The tail-strap portion has a rough velcro area (7) and a smooth velcro area (8). In a preferred embodiment, the closure of the rough velcro area with the smooth velcro area enables the tail-strap to clasp undergarments.

In a preferred embodiment, both the rough velcro area and the smooth velcro area are approximately ¾ inches wide and 3¾ inches long, with an 8 inch section of the tail-strap that separates them.

Item (10) designates a looped handle. The looped handle is used to attach invention to a raised item in the restroom, such as a door knob or a door hook. Item (9) designates a standard "dog-leash" connector that secures the looped handle to the body portion of the invention.

In a preferred embodiment, the looped handle is approximately 6 inches long and a half inch wide.

Item (11) designates a dye-cut hole in the lining of the left flap of the invention. Item (15) designates a dye-cut hole in the lining of the right flap of the invention. Both (11) and (15) enable access to toilet paper stored in the left slash pockets (6) or the right slash pocket (14), respectively.

In a preferred embodiment, the dye-cut ovular hole is approximately 4 inches high and 1½ inches wide.

The foregoing description comprises illustrative embodiments of the present invention.

As will be appreciated, the foregoing objects and examples are exemplary and embodiments need not meet all or any of the foregoing objects, and need not include all or any of the exemplary features described herein. Additional aspects and embodiments within the scope of the claims will be devised by those having skill in the art based on the teachings set forth herein.

While the invention has been described in connection with what are considered to be exemplary embodiments, it is to be understood that the invention is not limited to the disclosed embodiments, but on the contrary, is intended to cover various modifications and equivalent arrangements included within the spirit and scope of the appended claims.

I claim:

1. A method for the protection of undergarments, comprising the following steps:

a person is wearing an undergarment;

said person enters a toilet stall and removes said undergarment;

said person utilizes a device consisting of a left flap and a right flap, wherein the left flap has a left dye-cut ovular hole and the right flap has a right dye-cut ovular hole; a tail-strap portion consisting of a first hook and loop connector portion and a second hook and loop connector portion, wherein said tail-strap portion encircles said used undergarment and forms a connecting attachment between said first hook and loop connector portion and said second hook and loop connector portion, whereby said person folds the tail-strap portion around said undergarment and securing its position with the snap closure webbing.

* * * * *